US005556008A

United States Patent [19]

Silver et al.

[11] Patent Number: 5,556,008

[45] Date of Patent: Sep. 17, 1996

[54] SOFT-CUP FEEDER

[75] Inventors: Brian H. Silver, Cary; Larry D. Annis, Elgin, both of Ill.

[73] Assignee: Medela, Inc., McHenry, Ill.

[21] Appl. No.: 225,279

[22] Filed: Apr. 8, 1994

[51] Int. Cl.[6] ..... B67D 1/07

[52] U.S. Cl. ..... 222/192; 222/205; 222/207; 30/141; 215/DIG. 5

[58] Field of Search ..... 215/11.4, 11.5, 215/228, 307, 309, 311, 315, 100 R, DIG. 5, 390, 391; 220/212, 203, 204, 206, 209, 366, 303, 703, 705, 714, 715, 717, 735; 222/207, 212, 213, 191, 192, 205; 30/123.3, 125, 141; 426/111, 115, 117

[56] References Cited

U.S. PATENT DOCUMENTS

| | | | |
|---|---|---|---|
| 2,252,119 | 8/1941 | Edmonds | 30/141 X |
| 2,743,042 | 4/1956 | Burgin | 222/212 X |
| 3,133,679 | 5/1964 | Brown | 222/205 |
| 3,456,650 | 7/1969 | Schwartzman | 222/212 X |
| 4,091,965 | 5/1978 | Gebhard | 222/192 |
| 4,192,360 | 3/1980 | Rodriquez | 215/DIG. 5 X |
| 4,740,196 | 4/1988 | Powell . | |
| 4,929,229 | 5/1990 | Larsson . | |
| 5,137,183 | 8/1992 | Mikulec et al. | 222/212 X |
| 5,305,928 | 4/1994 | Verdaguer | 222/192 |

FOREIGN PATENT DOCUMENTS 2169210 7/1986 United Kingdom .

OTHER PUBLICATIONS

How to Feed a Baby Who Cannot Breastfeed, International Baby Food Action Network, Nairobi, Kenya Africa, 2 pages.

*Primary Examiner*—Stephen K. Cronin
*Attorney, Agent, or Firm*—Brinks Hofer Gilson & Lione

[57] ABSTRACT

An improved feeding utensil which includes a container for liquid and a soft spoon shaped feeding portion which receives liquid from the container for feeding, such as for feeding an infant. A preferred embodiment has a one-way valve which functions to allow liquid to flow out from the container into a liquid delivery element, the latter including a reservoir portion for temporarily storing liquid that has passed from the container through the one-way valve, and a spoon shaped feeding portion adapted for feeding the liquid received from the reservoir portion. The liquid delivery element is constructed of soft plastic material or natural or synthetic rubber material. The flexibility of this material facilitates metering of the liquid and also provides a familiar textured feeding cup for inserting into the mouth that is being fed.

16 Claims, 2 Drawing Sheets

SOFT-CUP FEEDER

FIELD OF THE INVENTION

The invention relates to an improved liquid feeding utensil having a liquid container and a spoon shaped feeding portion communicating with the liquid container, and in particular such a utensil for feeding an infant.

BACKGROUND OF THE INVENTION

This invention relates to a feeding device for infants that have problems accepting nourishment in the normal manner.

Most newborn infants are born with an instinct to suckle their mother's breast. Breast-feeding has the advantages that breast milk is the best possible food and drink for the baby, protects the baby against disease and food is always ready and free from germs. In addition both the mother and the baby experience the beneficial experience of close contact.

There are situations in which babies that have normal suckling ability cannot be breast-fed for various reasons: for example the mother could be ill or not available to breast-feed. In these situations a bottle with a nipple is often used to feed the baby. Bottle-feeding has the disadvantage that it can cause babies to stop wanting to breast-feed (nipple confusion) and can cause them to suck in a way which can result in sore nipples. Since bottles can be propped up or held by mechanical devices, the beneficial experience of close contact with the mother is often lost.

Also some babies, for example those with neurological abnormalities such as cerebral palsy, mentally handicapped babies and babies born with mouth abnormalities such as cleft lips or cleft palates, do not have sufficient suckling ability to breast-feed. For babies with this condition it is very important that the caretaker has the ability to accurately control the quantity of liquid being fed to the baby. Poor suckling ability is also found in some babies who have been ill or have had an operation.

A device is disclosed in UK Patent Application No. 2,169,210 for feeding babies with poor sucking ability. This device includes a container for holding a supply of liquid food having a one-way valve that will permit liquid flow out of the container. The liquid flows from the container into a nipple having a slit-shaped opening. The nipple can be compressed by the person feeding the baby to thus force liquid through the slit-shaped opening into the baby's mouth. This device has the disadvantages that are inherent in nipple feeding devices, and since the liquid contained in the nipple can not be clearly seen by the caretaker, it is difficult to accurately control the quantity of liquid being dispensed to the infant.

Another method that is used to feed babies that cannot be breast-fed is to feed them with a cup. Although small cups can be used, the cup edges or lips are not typically contoured to fit the infants lips and do not direct the liquid to a narrow stream. As a result, liquid from the cup flows in a wider than optimum stream and often does not all flow into the infant's mouth. Also it is difficult to control or limit the quantity of liquid that is portioned to the infant for each sip. If more than the optimum amount is poured into the baby's mouth, the baby may choke or spit-up.

Still another method that is used to feed babies that cannot be breast-fed is to feed them with a spoon. Spoon-feeding can be tedious and time consuming because the spoon must be refilled from a food source after each spoonful. Spoon-feeding does have the advantages that the volume of liquid that is presented to the baby can be closely controlled and the liquid can be offered to the baby in a way that will tempt the baby to cooperate in the feeding process. Both cups and spoons also have the advantages that the mother and the baby experience the beneficial experience of close contact.

For the foregoing reasons, there is a need for a feeding device that presents liquids in carefully controlled quantities to infants, and in a manner that tempts and encourages the individual being fed to cooperate in the feeding process.

SUMMARY OF THE INVENTION

It is a principal objective of the present invention to provide an improved feeding utensil which includes a container for liquid and a soft spoon shaped feeding portion which receives liquid from the container for feeding, such as for feeding an infant. To this end, the invention in a presently preferred form generally comprises a container for storing a supply of liquid, as in the form of a bottle. A collar is used to fix a one-way valve onto the container mouth, and functions to allow liquid to flow out from the container. The collar further holds a liquid delivery element to the container with the one-way valve therebetween.

The liquid delivery element includes a reservoir portion for storing a quantity of liquid that has passed from the container through the one-way valve. A spoon shaped feeding portion adapted for feeding the liquid receives liquid from the reservoir, being in fluid communication with the reservoir. The liquid delivery element in this preferred form more particularly includes a lateral lobe extending along a side of the spoon shaped feeding portion, the lobe being defined in part by a flexible lobe sidewall inboard from a spoon shaped feeding portion lateral side edge. A slit orifice formed in this lobe sidewall is used for introducing liquid into the spoon shaped feeding portion from this lobe by squeezing the reservoir portion to force liquid from the lobe through the slit orifice when the reservoir portion is squeezed.

Most preferably, the liquid delivery element has a reservoir portion comprising a main flexible thimble-shaped chamber and a pair of parallel spaced apart lateral lobes extending from the chamber. These lateral lobes extend along opposite lateral sides of the spoon shaped feeding portion. Each of the lobes is defined in part by a flexible lobe sidewall inboard from a respective spoon shaped feeding portion lateral side edge. By providing a lobe on each side the device can be used with equal ease by people who are either right or left handed. Although the double lobe embodiment is preferred a single lobe embodiment is also contemplated. The aforementioned slit orifice is formed in one of the lobe sidewalls for introducing liquid into the spoon shaped feeding portion from the lobe, again, by squeezing the reservoir portion to force liquid from the lobe through the slit orifice. The flexible lobe sidewall of the other lobe forms a splashwall for the liquid forced through the slit orifice.

Many of the problems that are encountered when feeding babies with poor suckling ability are also encountered when attempting to feed invalids or handicapped humans and other mammals. Thus the advantages of this device are also has beneficial in the care of invalids and handicapped. The device can also be used a transitional learning device to teach infants to eat from a spoon.

The foregoing features and advantages of the present invention will be further understood upon consideration of the following detailed description of an embodiment of the invention taken in conjunction with the accompanying drawings, in which:

DETAILED DESCRIPTION OF THE PREFERRED EMBODIMENT

Figure 1:
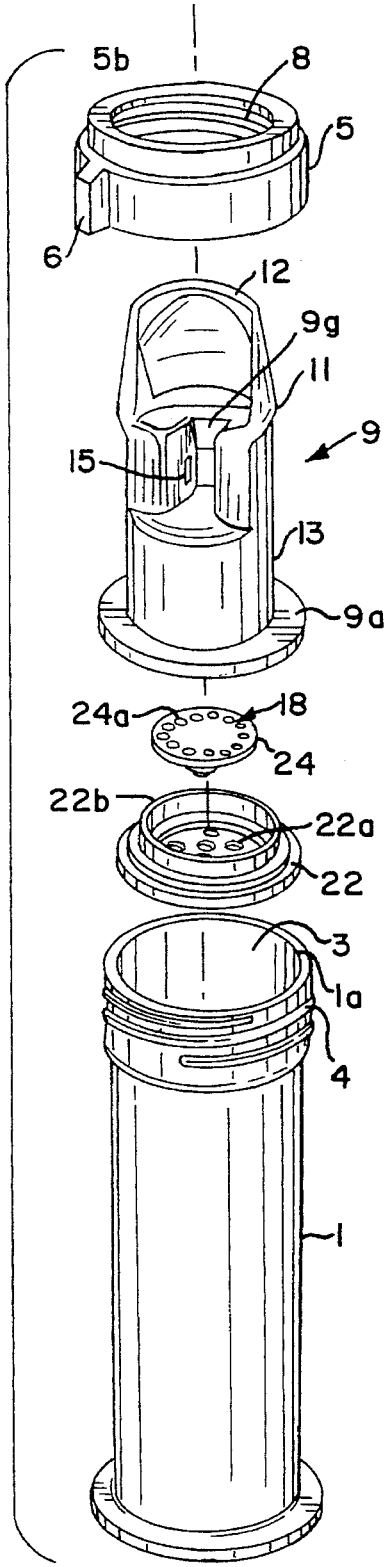
FIG. 1 is an exploded perspective view of an embodiment of the invention.
Figure 2:
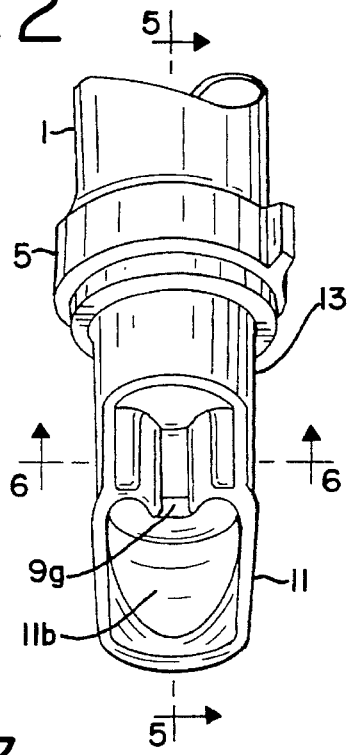
FIG. 2 is a top perspective view of the feeding end of the device.

As shown in FIG. 1, the illustrated embodiment of the inventive utensil for feeding liquids has a container 1 for storing a supply of liquid, with an open end 3 at one end of the container 1. The container 1 of the preferred embodiment is a rigid semi-transparent plastic container, made from a material such as polypropylene. Liquid measurement gradations can be provided on the container. In other embodiments of the invention the container could be in the form of a soft squeezeable container or flexible bag.

A cap member or collar 5 is sized to fit onto the open end 3 of the container 1. In this exemplary embodiment, screw threads 4 are provided on the outside of the container 1 adjacent the open end 3, with complementary screw threads 8 formed around the interior of the collar 5, for use in attaching the collar 5 to the container 1. A gripping protrusion 6 is provided on the exterior of the collar 5 for ease in turning the collar 5.

A one-way valve device 18 includes a disk-shaped base 22 which has a plurality of apertures 22*a*. The base 22 is sized to sit on the rim 1*a* of the mouth of the container 1. A short cylindrical ring 22*b* is formed inboard on the base 22.

Figure 5:
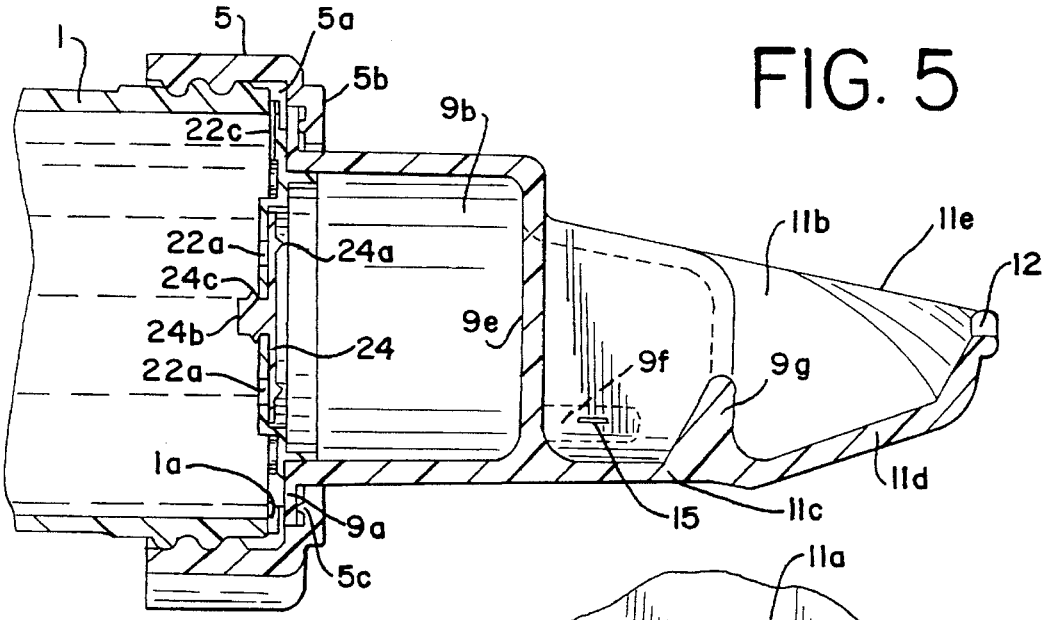
FIG. 5 is a cross section view taken along line 5—5 of FIG. 2.

The base 22 fits within a shoulder 5*a* formed within the collar 5 (FIG. 5). A small radial channel 22*c* is formed in the base 22 in the area which engages the rim 1*a* to permit air to enter the container in response to the withdrawal of liquid from the container. The threaded engagement between the collar 5 and the container 1 is loose enough to permit air to reach channel 22*c*. Alternatively, the threads can be broken to assure an air path.

A flexible disk-shaped member in the form of a thin flexible disk membrane 24 with reinforcing bosses 24*a* is in facial engagement with the base 22 and covers the apertures 22*a*. Disk membrane 24 functions to control the flow of liquid from the container 1 through the one-way valve mechanism 18. Disk membrane 24 includes a knob 24*b* having a rib 24*c*. The flexible disk member 24 is substantially identical to that disclosed in U.S. Pat. No. 4,929,229, the disclosure of which is herein incorporated by reference, and functions in the same manner as in that patent to control liquid flow. The flexible disk member 24 is attached to the base 22 by knob 24*b* which extends through an aperture in the base 22. A rib 24*c* formed on knob 24*b* functions to retain flexible disk member 24 in place on base 22. In use, the valve device 18 allows air to enter the container 1 through the threads and channel 22*c* formed in base 22 in response to the removal of liquid from the container through the apertures 22*a*, and disk member 24 operates as a flap valve permitting liquid flow from container 1 but not allowing the liquid to flow back into the container.

A liquid delivery element 9 includes a flexible spoon shaped feeding portion 11, adapted for feeding liquid, and a reservoir portion 13, for storing a portion of the liquid from the container 1. The liquid delivery element 9 preferably has an orifice 15, for transferring liquid from the reservoir portion 13 to the spoon shaped feeding portion 11 in a controlled manner, as hereinafter described. The liquid delivery element 9 is preferably made from a flexible material such as silicone, and is preferably formed in an integral piece.

Figure 4:
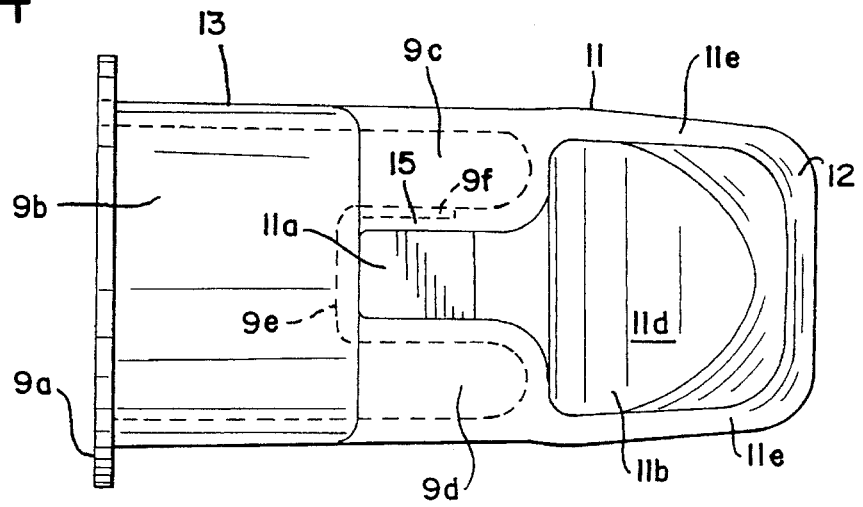
FIG. 4 is a plan view of the liquid delivery element.
Figure 6:
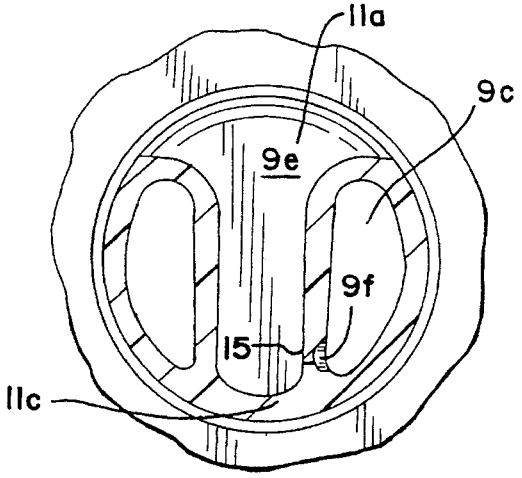
FIG. 6 is a cross section view taken along line 6—6 of FIG. 2.

With reference to FIGS. 4–6 in particular, the liquid reservoir portion 13 has a thimble-shaped chamber 9*b* which extends into lateral lobes 9*c* and 9*d*. The lobes 9*c*, 9*d* are separated by an upwardly open channel 11*a* forming part of the spoon shaped feeding portion 11. A wall 9*e* defines the front of the thimble-shaped chamber 9*b*. A well 11*b* forms the majority of the spoon shaped feeding portion, and is defined by spoon shaped feeding portion base part 11*c* forming the bottom of open channel 11*a*, and upwardly inclined part 11*d*. The angle of the upwardly inclined part 11*d* from the horizontal is about 20 degrees. The rear of the spoon shaped feeding portion 11 is defined by the wall 9*e* and forward wall portions of the lobes 9*c* and 9*d*. As can be best seen in FIG. 4 the top surfaces of the forward corners of upwardly inclined part 11*d* are contoured such that when the device is tilted forward liquid will flow toward the center of the lip 12. However if the device is tilted forward and to one side or the other liquid will flow to a corner of the lip 12. Thus, the person holding the device can select one of three different areas of the lip 12 to direct liquid to.

A dam 9*g* extends across the front of open channel 11*a* to produce a holding tank for the liquid. The liquid in this holding tank functions to minimize air flow back through orifice slit 15 into the reservoir portion 13. The liquid can be spilled over the dam 9*g* by tilting the forward end of the device downwardly or the holding tank can be filled to overflow.

Lip 12 has a slight arcuate curvature such that it is lower at its center than at is ends which better conforms to the shape of the baby's lip and contributes to directing the liquid to the center of the lip 12. The top edge of the spoon shaped feeding portion 11 is defined by edges 11*e* which extend substantially straight forward along the outer wall to both ends of lip 12, at a downwardly inclined angle of about 12 degrees from the horizontal.

The orifice 15 is formed in the lobe 9*c* at the base thereof and slightly above the spoon shaped feeding portion base part 11*c*. The orifice is a line-type slit 15 formed within a reduced thickness portion 9*f* of the sidewall defining the interior lateral side of the lobe 9*c*.

As shown in FIGS. 1 and 5 in particular, collar 5 is used to attach the liquid delivery element 9 to the container 1 at the open end 3. The liquid delivery element 9 has an open end within which the short cylindrical ring 22*b* of the base 22 of the one-way valve 18 is received, such that the short cylindrical ring 22*b* extends a small distance within the reservoir portion 13. A flat ring-shaped radial flange 9*a* is formed around the open end of the element 9 and overlies the base 22 in facial engagement therewith.

In assembly of the utensil for use, the collar 5 is slipped over the spoon shaped feeding portion 11 and moved down to the flange 9*a*. The flange 9*a* fits within the shoulder 5*a* (FIG. 5) of the collar. The collar 5 is then screwed onto the container 1, which has already been filled with liquid (e.g., milk, supplement, etc.) via the matching threads 4 and 8, with the flange 9*a* being compressed between an inboard extending collar flange 5*b* and the base 22. The other side of base 22 is forced against rim 1*a* of container 1. An annular bead 5*c* formed on the collar flange 5*b* facilitates an airtight engagement between the collar flange 5*b* and flange 9*a*.

Figure 3:
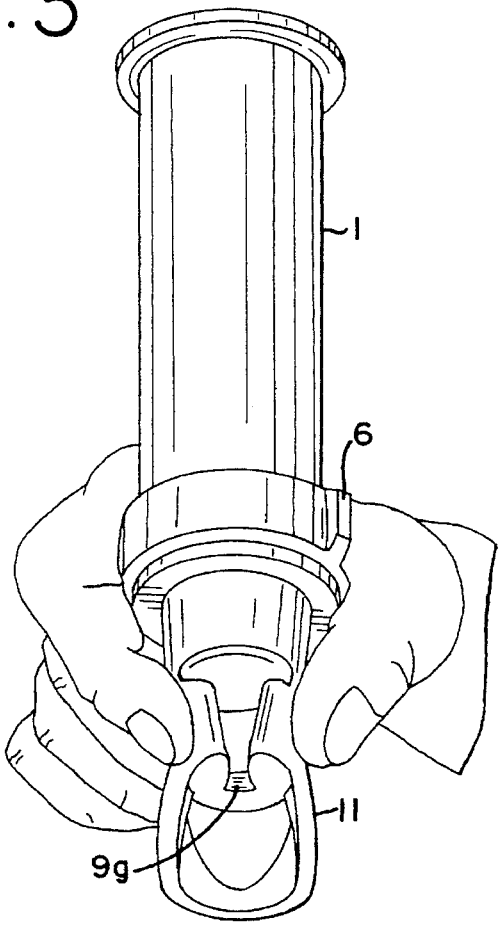
FIG. 3 is a top perspective view of the device being held by the person administering the feeding procedure.

The utensil is preferably primed before use. This is achieved by holding the utensil in a vertical orientation, with the liquid delivery element 9 facing upwards, squeezing the reservoir portion 13 to force air to escape through the orifice 15 (as in the manner shown in FIG. 3, but held with the element 9 upwards), and then turning the utensil approximately 180 degrees (as is shown in FIG. 3), so that the liquid delivery element 9 is facing downwards, and releasing the pressure on the reservoir portion 13. As the pressure on the outside of the reservoir portion 13 is released, the action of the reservoir portion 13 flexing back to its ordinary shape causes liquid to be drawn into the reservoir portion 13 from the container 1 through the one-way valve device 18. The priming process is preferably repeated several times until the reservoir portion 13 is almost full of liquid.

To feed with the utensil, the sides of the reservoir portion 13 are gently squeezed forcing liquid to flow out of the reservoir portion 13 through the orifice 15, forming a small pool of liquid in the spoon shaped feeding portion 11. Liquid forcibly expressed through the orifice slit 15 in this manner is directed toward the opposing sidewall of the lobe 9*d*, and then drops into the channel 11*a*.

The lip 12 of the spoon shaped feeding portion 11 can be used to tickle the baby's mouth open, as the utensil is offered to the baby. The person using the device can use his or her pinky finger to support the baby's chin during the feeding process. As the pooled liquid is consumed, the supply in the flexible spoon shaped feeding portion 11 may be replenished by gently squeezing the sides of the reservoir portion 13.

The utensil can be readily cleaned between uses by disassembling the parts, and washing all of the parts in warm soapy water, and rinsing the parts with cold water. The utensil should also be sanitized before use, preferably by boiling it in distilled water for three minutes, or by using an autoclave or a chemical sanitizing solution.

Thus, while the invention has been described in connection with a certain presently preferred embodiment, those skilled in the art will readily recognize many modifications of structure, arrangement, portions, materials, and components which can be used in the practice of the invention without departing from the principles of the invention.

We claim:

1. A utensil for feeding liquids, comprising:

a container for storing a supply of liquid, said container having an open end;

a cap member for closing said open end, said cap member including a one-way valve that functions to allow liquid to flow out from said container;

a liquid delivery element adapted to be attached to said container at said open end and in fluid communication with said one-way valve, said liquid delivery element including a reservoir portion for storing a quantity of liquid that has passed from said container through said one-way valve;

said liquid delivery element further including a spoon shaped feeding portion that receives liquid from said reservoir portion, said spoon shaped feeding portion being formed of a flexible resilient material said reservoir portion being in fluid communication with said spoon shaped feeding portion, and said spoon shaped feeding portion being adapted for feeding the liquid.

2. The feeding utensil of claim 1 wherein said liquid delivery element is made of a soft and flexible silicone.

3. The feeding utensil of claim 1 wherein said container is rigid polypropylene.

4. A utensil for feeding liquids, comprising:

a container for storing a supply of liquid, said container having an open end;

a closure for said open end, said closure including a one-way valve that functions to allow liquid to flow out from the container;

a liquid delivery element adapted to be attached to said container at said open end and in fluid communication with said one-way valve, said liquid delivery element including a reservoir portion for storing a quantity of liquid that has passed from said container through said one-way valve;

said liquid delivery element further including a spoon shaped feeding portion that receives liquid from said reservoir portion, said liquid delivery element having a lateral lobe extending along a side of said spoon shaped feeding portion, said lateral lobe defined in part by a flexible lobe sidewall inboard from a lateral side edge of said spoon shaped feeding portion, with a slit orifice formed in said lobe sidewall for introducing liquid into said spoon shaped feeding portion from said lateral lobe by squeezing said reservoir portion to force liquid from said lateral lobe through said slit orifice, said spoon shaped feeding portion being adapted for feeding the liquid.

5. The feeding utensil of claim 4 in which said spoon shaped feeding portion of said liquid delivery element is formed of a flexible resilient material.

6. A utensil for feeding liquids, comprising:

a container for storing a supply of liquid, said container having an open end;

a closure for said open end, said closure including a one-way valve that functions to allow liquid to flow out from the container;

a liquid delivery element adapted to be attached to said container at said open end and in fluid communication with said one-way valve, said liquid delivery element including a reservoir portion for storing a quantity of liquid that has passed from said container through said one-way valve;

said liquid delivery element further including a spoon shaped feeding portion that receives liquid from said reservoir portion, and wherein said reservoir portion comprises a main flexible thimble-shaped chamber and a lateral lobe connected to said chamber and extending along a lateral side of said spoon shaped feeding portion, said lateral lobe being defined in part by a flexible lobe sidewall spaced from a lateral side edge of said spoon shaped feeding portion, a slit orifice formed in said lateral lobe sidewall introducing liquid into said spoon shaped feeding portion from said lateral lobe upon squeezing said reservoir portion to force liquid from said lateral lobe through said slit orifice.

7. The feeding utensil of claim 6 wherein there are a pair of parallel lateral lobes that extend along opposite sides of said spoon shaped feeding portion, and wherein said slit orifice that is formed in one of the lateral lobe sidewalls utilizes the other lateral lobe sidewall as a splashwall for the liquid forced through said slit orifice.

8. A utensil for feeding liquids, comprising:

a container for storing a supply of liquid, said container having an open end;

a liquid delivery element adapted to be attached to said container about said open end, said liquid delivery element including a compressible reservoir portion for storing a measure of liquid that has passed from said container;

said liquid delivery element further including a spoon shaped feeding portion having a front lip and a lateral internal lobe formed in said spoon shaped feeding portion, said lateral internal lobe receiving liquid from said reservoir portion, and having an orifice through which liquid is delivered to said spoon shaped feeding portion in a stream which is directed away from said front lip when said reservoir portion is compressed, said spoon shaped feeding portion being adapted for feeding the liquid.

9. The feeding utensil of claim 8 wherein said spoon shaped feeding portion is formed from a soft flexible material.

10. A utensil for feeding liquids, comprising:

a container for holding a supply of liquid therein, said container having an opening through which said supply can flow;

a liquid delivery element attached to said container about said opening, said liquid delivery element including a compressible reservoir portion for storing a measure of liquid that has passed from said container;

said liquid delivery element further including a spoon shaped feeding portion which is formed of a flexible resilient material, said spoon shaped feeding portion having a bottom, opposed lateral sides extending upwardly from said bottom which lateral sides are movable relative to said bottom, said spoon shaped feeding portion further including a front lip, said spoon shaped feeding portion being in fluid communication with and receiving liquid from said reservoir portion via an orifice defined in said reservoir portion, said reservoir portion when compressed delivering liquid within said reservoir portion to said spoon shaped feeding portion through said orifice.

11. A utensil for feeding liquids, comprising:

a container for holding a supply of liquid therein, said container having an opening through which said supply can flow;

a closure for said container opening including a one-way valve that functions to allow liquid to flow out from said container;

a liquid delivery element attached to said container about said opening and one-way valve, said liquid delivery element including a reservoir portion for storing a measure of liquid that has passed from said container through said one-way valve;

said liquid delivery element further including a spoon shaped feeding portion which is formed of a flexible resilient material, said spoon shaped feeding portion having a bottom, opposed lateral sides extending upwardly from said bottom, a front lip, and at least one lateral internal lobe which forms part of said reservoir portion, said lateral lobe having an orifice therein through which liquid supplied to said lateral lobe can flow;

said liquid delivery element when compressed delivering liquid within said reservoir portion to said spoon shaped feeding portion through said orifice of said lateral internal lobe.

12. A utensil for feeding liquids, comprising:

a container for holding a supply of liquid therein, said container having an opening through which said supply can flow;

a liquid delivery element attached to said container about said opening, said liquid delivery element including a spoon shaped feeding portion having a bottom, opposed lateral sides extending upwardly from said bottom, a front lip, a back wall opposite from said front lip, and a dam extending between said lateral sides along said bottom and spaced from said front lip;

said liquid delivery element having an orifice defined therein which is in fluid communication with said container, said orifice being spaced farther from said front lip than said dam, a holding tank being thereby defined in said spoon shaped feeding portion by said dam, lateral sides and back wall, and into which holding tank liquid from said container initially can collect after passing through said orifice.

13. The feeding utensil of claim 12 wherein said liquid delivery element further includes a flexible compressible reservoir portion which is in fluid communication with said container, said reservoir portion extending into an internal lateral lobe defined along a side of said holding tank, said orifice extending into said internal lateral lobe, said reservoir portion when compressed delivering liquid within said reservoir portion to said holding tank of said spoon shaped feeding portion through said orifice.

14. The feeding utensil of claim 13 wherein said orifice is located in said holding tank at a point below an edge defining a top to the dam, and wherein said top to said dam is located at a point which is below said front lip relative to said bottom.

15. The feeding utensil of claim 14 further including a closure for said container opening, said closure having a one-way valve that functions to allow liquid to flow out from the container, said liquid delivery element being attached to said container about said opening and one-way valve with said reservoir portion receiving liquid that has passed from said container through said one-way valve;

said spoon shaped feeding portion and said reservoir portion being formed of a flexible resilient material with said opposed lateral sides being movable relative to said bottom.

16. The feeding utensil of claim 15 wherein said orifice that is formed in one of said lateral sides utilizes the opposed lateral side as a splashwall for the liquid forced through said orifice.

* * * * *

UNITED STATES PATENT AND TRADEMARK OFFICE

CERTIFICATE OF CORRECTION

PATENT NO. : 5,556,008

DATED : September 17, 1996

INVENTOR(S) : Brian H. Silver et al.

It is certified that error appears in the above-indentified patent and that said Letters Patent is hereby corrected as shown below:

In the Claims

Column 6,

In Claim 6, line 22, after "sidewall", insert --for--.

Signed and Sealed this

Seventh Day of October, 1997

*Attest:*

Bruce Lehman

BRUCE LEHMAN

*Attesting Officer*

*Commissioner of Patents and Trademarks*